United States Patent [19]

Riikonen

[11] 4,303,259

[45] Dec. 1, 1981

[54] SKI BINDING

[75] Inventor: Pentti Riikonen, Lahti, Finland

[73] Assignee: Adidas Fabrique de Chaussures de Sport, Landersheim, France

[21] Appl. No.: 796,240

[22] Filed: May 12, 1977

[30] Foreign Application Priority Data

May 14, 1976 [FI] Finland ..... 761383

[51] Int. Cl.[3] ..... A03C 9/18

[52] U.S. Cl. ..... 280/615; 36/117

[58] Field of Search ..... 280/615, 613; 36/117

[56] References Cited

U.S. PATENT DOCUMENTS

| | | | |
|---|---|---|---|
| 3,603,606 | 9/1971 | Eie | 280/615 |
| 3,612,558 | 10/1971 | Kjellstrom | 280/615 |
| 4,082,312 | 4/1978 | Johnson | 280/615 |

*Primary Examiner*—Joseph F. Peters, Jr.
*Assistant Examiner*—Milton L. Smith
*Attorney, Agent, or Firm*—Brisebois & Kruger

[57] ABSTRACT

A ski binding for a cross country or touring ski. The binding has an archplate to receive an integral forward extension of the sole of the ski boot, and a crossbar engages behind a shoulder on the extension to fasten the boot to the ski. The crossbar forms an upper transverse portion of the archplate and also fastens the extension of the boot in the binding.

6 Claims, 5 Drawings

SKI BINDING

This invention relates to a ski binding to secure a shoe or boot to a ski, particularly a touring or cross country ski, the binding being of a type in which the boot is held by an extension of its sole at the front of the boot. The extension fits in an archplate fixed to the ski and which defines a space or volume whose form corresponds in width and height to that of the sole extension. The boot is held to the ski by a latching member which secures the extension of the sole in the archplate.

An object of this invention is a ski binding for fixing a boot to a ski, particularly of the cross country or touring type, the binding comprising a latching means which in the fastened position also forms the upper horizontal portion of the archplate.

In the preferred embodiment, the latching means comprises a movable piece which constitutes the upper part of the arch and which can be brought against an upright shoulder on the extension of the sole to assure fastening and holding the extension of the sole in the binding.

In accordance with the preferred embodiment, the latching member takes the form of a transverse horizontal bar able to be raised and lowered in relation to the vertical sides of the archplate, this bar forming the upper transverse part of the archplate and being able to engage against a shoulder of the sole extension for assuring the locking or fastening.

In a practical or working embodiment, the bar is of integral construction with two side arms arcuately curved and which slide in opposed grooves of corresponding form in the vertical sides of the archplate, under the action of a tilting lever pivotally connected at one end of the arcuately curved arms. By engaging an integral fulcrum of the archplate, this lever is able to draw or pull the bar against the shoulder of the sole extension to attain the fastening.

A preferred embodiment of the invention will now be described, purely by way of illustration and example, with reference to the accompanying drawings.

Figure 1:
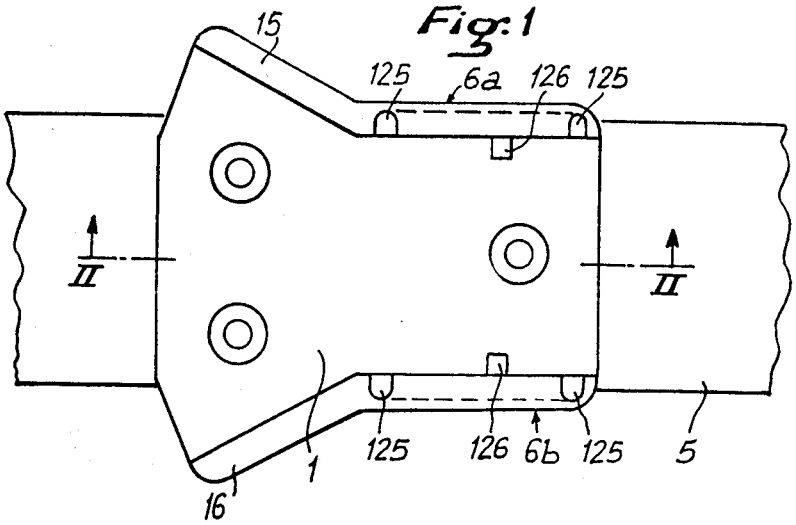
FIG. 1 is a top plan view of the archplate according to the invention, with the locking members removed for purposes of clarity of illustration.

As shown in the drawings, a plate 1 forms the base of an archplate 2, and is fixed to the ski 5 by screws. The upright sides 6*a* and 6*b* of the archplate have extensions in the form of divergent vertical wings 15 and 16 which extend beyond the sides of the ski to receive and engage the sides of the boot and of the sole which are shown in phantom lines in the drawings.

The sole of the boot has an integral front extension 8 which, in the preferred embodiment, is formed by molding the sole 26 in one piece, for example, by injection molding of plastic.

In this embodiment, the sole 26 is joined to the extension 8 at a location 30 of lesser thickness which forms a shoulder 49 facing toward the rear of the ski and which is used for securing the boot with the assistance of the binding according to the invention.

Figure 3:
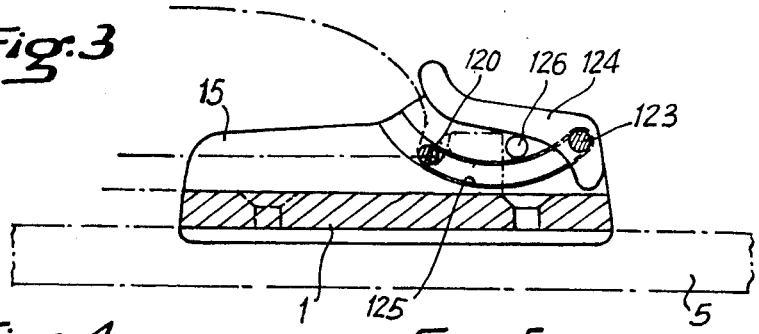
FIG. 3 is a view corresponding to FIG. 2 and showing the binding closed and locked.
Figure 4:
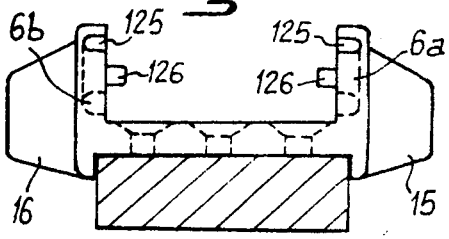
FIG. 4 is a right hand end view of the arch of FIG. 1.
Figure 5:
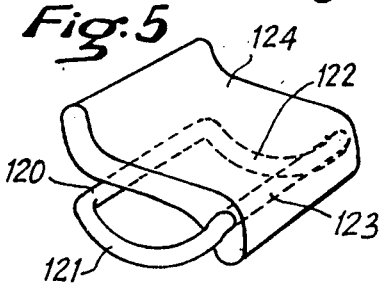
FIG. 5 is a perspective view of the locking bar and lever assembly.

It is clear from FIGS. 3 and 5 how a bar 120, according to the invention, forms both an upper horizontal portion of the archplate, and the fastening member. The bar is of integral construction and has two side arms 121 and 122 and an end portion 123 on which a one piece lever 124 is formed, and pivotally connected. The arms which are arcuately curved are capable of sliding in the grooves 125 of corresponding curvature, and which are formed in the inside faces of the vertical sides 6*a* and 6*b* of the archplate.

Figure 2:
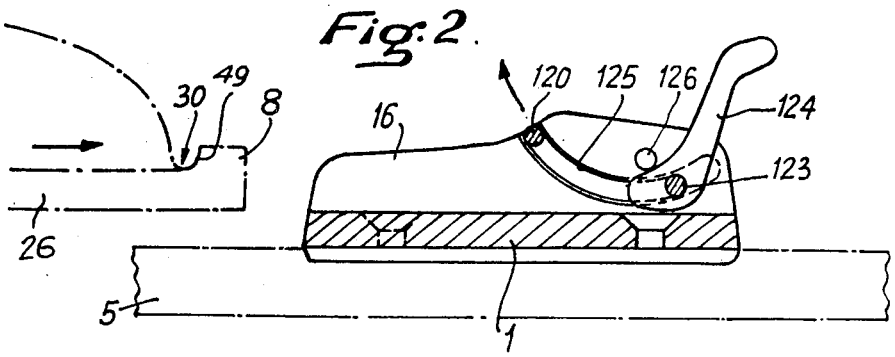
FIG. 2 is a side view in section taken along line II—II of FIG. 1, and showing the binding released.

FIG. 2 shows the manner of introduction of the sole extension into the archplate. In FIG. 2 the bar 120 has been moved in the direction of the arrow to its raised or unfastened position.

After inserting the extension 8 of the boot in the archplate, the free end of the lever is pulled to the left (from the position of FIG. 2), the lever engaging the fulcrums 126 which project toward each other from the sides 6*a* and 6*b* of the archplate to cause the sliding of the arms 121 and 122 in their grooves, and the lowering and forward movement of the bar 120 which enters the reduced thickness region 30 behind shoulder 49 to assure the fastening as shown in FIG. 3. Because of the location at which the lever engages fulcrums 126, a mechanical advantage is obtained, and the resulting pull assures that the extension is drawn into the archplate and that the front face of the extension 8 abuts against the fulcrum pins 126, as shown at FIG. 3.

One can understand thus that according to the invention, the bar 120 functions as both the fastening member and also as the upper horizontal portion of the archplate. In addition, the bar can pull the extension into the archplate.

To unfasten the boot from the ski, from the fastened condition shown at FIG. 3, the lever 124 is pivoted to the right to disengage bar 120 from the reduced thickness region 30 of the sole extension 8, and raise the bar to a position above the extension. In this position, as shown at FIG. 2, the extension of the boot is released.

As is apparent from FIG. 3, when the binding is fastened, the lever 124 forms a more or less streamlined continuation of the toe of the shoe. This tends to reduce drag when skiing in soft snow. In addition, the lower front tip of lever 124, in the fastened position of FIG. 3, is very close to plate 1 so that snow cannot enter the binding and cause it to jam.

What is claimed is:

1. A ski binding for fastening to a touring or cross country ski, a boot having a forward extension and a shoulder between the front end of the extension and the body of the boot, said binding comprising, an archplate fixed to the ski and comprising two upright sidewalls, said archplate defining an upwardly open cross section of a form corresponding to the height and width of the forward extension, and means for locking the forward extension to the archplate against rearward and upward movement with respect to said archplate and comprising a fastening device having a horizontal portion movable downwardly relative to the walls of the archplate to a fastening position engaging said shoulder and maintaining said extension locked between said upright walls of the archplate.

2. A ski binding according to claim 1 wherein, said horizontal portion comprises a bar, and said locking means further comprises means for moving said bar to said fastening position.

3. A binding according to claim 2 in which the bar forms an upper transverse part of the archplate, and comes into engagement against said shoulder of the extension of the sole to assure the fastening.

4. A binding according to claim 2 in which the bar is integral with two arcuately curved side arms which slide under the action of a swingable lever in grooves of corresponding curvature formed in vertical sides of the archplate.

5. A binding according to claim 4 in which the swingable lever engages a fulcrum of the archplate and is pivoted to the end of the curved arms said lever pressing the bar against the shoulder of the sole extension to assure fastening of the boot to the binding.

6. A ski binding according to claim 1 wherein said horizontal portion of said fastening device comprises the sole means on the device for preventing rearward and upward movement of said extension with respect to said archplate.

* * * * *